US006698365B2

(12) United States Patent
Shibata

(10) Patent No.: US 6,698,365 B2
(45) Date of Patent: Mar. 2, 2004

(54) APPARATUS FOR THERMAL TREATMENT USING SUPERHEATED STEAM

(75) Inventor: Katsumi Shibata, Nakama (JP)

(73) Assignee: S.T.M. Co., Ltd., Kitakyushu (JP)

( * ) Notice: Subject to any disclaimer, the term of this patent is extended or adjusted under 35 U.S.C. 154(b) by 0 days.

(21) Appl. No.: 10/166,408

(22) Filed: Jun. 11, 2002

(65) Prior Publication Data

US 2003/0136317 A1 Jul. 24, 2003

(30) Foreign Application Priority Data

Jan. 23, 2002 (JP) ..... 2002-014203

(51) Int. Cl.[7] ..... F23G 7/00; C10B 49/00

(52) U.S. Cl. ..... 110/246; 110/226; 110/227; 110/228; 110/234; 110/246; 110/259; 432/106; 202/216

(58) Field of Search ..... 48/197 R; 110/219, 110/224, 226, 227, 228, 233, 234, 246, 255, 259, 346; 106/750, 760; 432/103, 106; 201/38; 202/16, 216; 422/209; 34/92

(56) References Cited

U.S. PATENT DOCUMENTS

| | | | | | |
|---|---|---|---|---|---|
| 1,784,985 | A | | 12/1930 | Davies Jr. | |
| 2,879,052 | A | | 3/1959 | Azbe | 263/33 |
| 3,716,002 | A | * | 2/1973 | Porter et al. | 110/14 |
| 3,771,263 | A | | 11/1973 | Borggreen et al. | 48/209 |
| 3,859,933 | A | * | 1/1975 | Von Klenck | 110/8 R |
| 4,273,619 | A | * | 6/1981 | Angelo, II | 202/211 |
| 4,344,821 | A | * | 8/1982 | Angelo, II | 201/33 |
| 4,516,511 | A | * | 5/1985 | Kuo | 110/346 |
| 4,568,425 | A | * | 2/1986 | Putnam et al. | 202/108 |
| 4,588,429 | A | | 5/1986 | Hohman et al. | 65/27 |
| 4,656,955 | A | * | 4/1987 | Kuo | 110/346 |
| 4,794,871 | A | * | 1/1989 | Schmidt et al. | 110/341 |
| 4,840,129 | A | * | 6/1989 | Jelinek | 110/229 |
| 4,970,970 | A | | 11/1990 | Avery | 110/246 |
| 5,101,740 | A | * | 4/1992 | Abril | 110/230 |
| 5,411,714 | A | * | 5/1995 | Wu et al. | 422/232 |
| 5,466,383 | A | | 11/1995 | Lee | 210/774 |
| 5,788,481 | A | * | 8/1998 | Von Beckman | 432/103 |
| 5,817,163 | A | * | 10/1998 | Wood | 75/403 |

FOREIGN PATENT DOCUMENTS

DE 199 38 034 A 2/2001

OTHER PUBLICATIONS

European Search Report dated Apr. 14, 2003.

* cited by examiner

*Primary Examiner*—Ira S. Lazarus
*Assistant Examiner*—K. B Rinehart
(74) *Attorney, Agent, or Firm*—Armstrong, Westerman & Hattori, LLP.

(57) ABSTRACT

Material to be treated such as garbage is charged into a first rotary kiln 14 to be mainly dehydrated and charged into a second rotary kiln 18 to be carbonized. The first rotary kiln 14 has a first nozzle pipe 11 therein for spouting a first high temperature gas and the second rotary kiln 18 has a second nozzle pipe 15 for spouting a second high temperature gas, mainly high temperature superheated steam with a temperature higher than a temperature of the first high temperature gas. The carbonized material is discharged outside after a temperature thereof is lowered to prevent spontaneous combustion in an atmosphere. Thereby, it is able to provide an apparatus for thermal treatment using superheated steam which can be built relatively small and by which treatment time can be shortened, and further, the final carbonized material can be used as charcoal.

14 Claims, 3 Drawing Sheets

APPARATUS FOR THERMAL TREATMENT USING SUPERHEATED STEAM

BACKGROUND OF THE INVENTION

The present invention relates to an apparatus for thermal treatment wherein material to be treated is dehydrated (or dried) and thermally decomposed in a substantially oxygen-free state using mainly superheated steam. Here, the material to which the present apparatus is applicable is viscous and/or solid material excluding liquid and gaseous matter, for example, waste comprising one or more of garbage generated in general households, plants, restaurants or the like, used paper diapers, waste plastics easy to generate dioxin during combustion and other plastics, livestock excrement or human wastes, and sludge residue generated in sewage disposal plants. Further, the apparatus for thermal treatment according to the present invention can be applied to dehydration or thermal decomposition of materials or products comprising various kinds of organic and inorganic materials used at plants or the like.

Conventionally, for disposing of waste generated such as in plants and households, an incineration method has been adopted in view of a merit that a large quantity of waste can be treated at a relatively low cost. Moreover, various kinds of methods, such as an incineration method having a reaction zone where dioxin can be decomposed, a hydrothermal reaction method, a plasma reaction method and so forth have been proposed for disposing of waste containing toxic constituents to human bodies and an environment, such as CFC, PCB and trichloroethylene or the like, or waste plastics containing a chlorine element, since dioxin will generate by the simple incineration disposal. Further, for dehydrating materials and products at plants, dehydration using hot wind comprising air, nitrogen gas, or the like has been performed.

However, the above-mentioned conventional incineration method for disposing of waste has the following drawbacks. Since heat capacity generated during the incineration varies with calorie contained in the waste to be treated, it is difficult to control a furnace temperature. That is, in case of disposing of material containing much water or with a low calorie by the incineration, it is necessary to heat by a supplemental burner. On the other hand, in case of disposing of flammable material such as lumbers or papers by the incineration, the material burns by itself (namely, spontaneous combustion) without necessity of heating by the supplemental burner. However, it is necessary to control a charge of the material to be treated lest a temperature of a furnace should become too high. Further, when such waste with a high heat capacity is included as part of the waste to be treated, there is a problem such that the furnace temperature becomes high partially.

There is another treatment method in which the waste is first put into an oxygen-free furnace to be carbonized, and gas generated therefrom is subjected to a secondary combustion in another furnace. However, since it is difficult to heat the waste while stirring in the oxygen-free furnace, it takes much time to treat the waste, and further, when the waste contains chloride, it is necessary to install an apparatus additionally to treat generated dioxin.

Alternatively, to detoxify dioxin, CFC, PCB and trichloroethylene, the hydrothermal reaction method is extremely effective. However, since conditions of decomposition are high-temperature and high-pressure, such as the temperature is in a range of 300 to 450° C. and the pressure is in a range of 100 to 250 kg/cm$^2$, a vessel used in a decomposition apparatus needs to be resistant to high-temperature and high-pressure. Consequently, construction, maintenance and running costs of the apparatus are high and also, it is difficult to perform a continuous treatment. Therefore, the hydrothermal reaction method is not suitable for disposing of the above-mentioned waste. Furthermore, the plasma reaction method wherein the above-mentioned toxic substances are introduced into high temperature plasma for decomposition has a drawback that an apparatus and treatment costs are extremely high.

Next, in the dehydration of the material to be treated using air or nitrogen, a heat exchanger is necessary for raising the temperature of air or nitrogen to a high temperature. However, since heat capacities of air and nitrogen are small, a large heat exchanger is indispensable for treating a large amount of the material, thus when a treatment temperature exceeds 500° C., the dehydration is not performed generally in the present situation.

BRIEF SUMMARY OF THE INVENTION

The present invention is achieved in view of the above situation, and aims to provide an apparatus for thermal treatment using high temperature superheated steam performing dehydration (drying) and thermal decomposition of material (including waste), whereby a whole apparatus can be built relatively small and moreover, a treatment time can be shortened.

An apparatus for thermal treatment using superheated steam according to the present invention for attaining the above object comprises: a first rotary kiln having a first nozzle pipe therein for spouting a first high temperature gas, a first charge portion of material to be treated on one side thereof and a first discharge portion of the material dehydrated with the first high temperature gas on the other side thereof, the first high temperature gas comprising one or both of high temperature superheated steam and high temperature combustion exhaust gas; a second rotary kiln having a second nozzle pipe therein for spouting a second high temperature gas, a second charge portion of the material dehydrated by the first rotary kiln on one side thereof and a second discharge portion of the material carbonized with the second high temperature gas on the other side thereof respectively, the second high temperature gas comprising mainly high temperature superheated steam with a temperature higher than a temperature of the first high temperature gas; and a mechanism for discharging treated material provided to the second discharge portion of the second rotary kiln for discharging the carbonized material outside after lowering a temperature of the material in an oxygen-free state so that spontaneous combustion of the carbonized material may not occur in an atmosphere.

Thereby, the material can be thermally treated in two-steps at the first and second rotary kilns separately, i.e., dehydration and partial carbonization of the material can be carried out in the first rotary kiln, and perfect carbonization of the dehydrated and partially carbonized material can be carried out in the second rotary kiln. Further, if superheated steam is used as a heat source in the first and second rotary kilns, when the steam temperature is lowered, the superheated steam turns into water. Thereby, treatment of exhaust gas becomes easy. Accordingly, by using the two rotary kilns with different roles to treat the material, the thermal treatment can be carried out more evenly compared to a case where the thermal treatment of the material is carried out in only one rotary kiln, and further, efficient treatment becomes possible by properly dispersing heat energy into the two rotary kilns. Moreover, since the mechanism for discharging treated material is provided by which the material from the second rotary kiln is discharged outside after the temperature is lowered in an oxygen-free state so that the treated material may not burn by itself in an atmosphere, spontaneous combustion of the thermally treated material can be prevented when the material is discharged in the atmosphere. Further, it is preferable that the material to be treated is fractured to 2 cm or smaller (still preferably, 0.5–1.5 cm or so), and further to be granular. However, the present invention is not limited to a size and form of the material to be treated.

Additionally, in the apparatus for thermal treatment using superheated steam according to the present invention, it is preferable that the first rotary kiln is disposed above the second rotary kiln, the first discharge portion of the first rotary kiln having a chute for discharging the material from the first rotary kiln, a screw conveyor for feeding material which feeds the material discharged from the chute into the second rotary kiln being provided to the second charge portion of the second rotary kiln, the first discharge portion and the second charge portion being connected. Thereby, conveying the material from the first rotary kiln to the second rotary kiln becomes easy and the flow of the material becomes continuous. Moreover, a space necessary to install the apparatus becomes small.

Furthermore, in the apparatus for thermal treatment using superheated steam according to the present invention, it is preferable that the first and second nozzle pipes are extended in a fixed state from one side to the other side in kiln bodies of the first and second rotary kilns respectively, many nozzles for spouting high temperature gas being provided at intervals to the first and second nozzle pipes respectively. Thereby, high temperature superheated steam or high temperature combustion exhaust gas, namely the first high temperature gas, can be blown evenly in the kiln body of the first rotary kiln, and very high temperature superheated steam, namely the second high temperature gas, can be blown evenly in the kiln body of the second rotary kiln. Particularly since the kiln bodies rotate, the material is stirred. Thus, heat travels through the material within a relatively short time. Further, it is preferable that the first and second nozzle pipes are provided from one end (edge) toward the other end (edge) of the first and second rotary kilns respectively, the first and second nozzle pipes being in parallel with axes of the respective kiln bodies.

Still furthermore, in the apparatus for thermal treatment using superheated steam according to the present invention, it is preferable that the first high temperature gas supplied to the first rotary kiln is comprised of high temperature gas in a range of 200–700° C. (still preferably, 200–400° C.), and the second high temperature gas supplied to the second rotary kiln is comprised of superheated steam in a range of 400–1000° C. that is higher than the temperature of the first high temperature gas used in the first rotary kiln. Thereby, it is possible to perform a two-step treatment with different heating temperatures in the first and second rotary kilns. Namely, in the first rotary kiln, dehydration of the material can be carried out mainly, and in the second rotary kiln, carbonization of the material can be carried out. Here, it is to be noted that the present invention is not limited to these temperature ranges.

Still furthermore, in the apparatus for thermal treatment using superheated steam according to the present invention, it is preferable that the mechanism for discharging treated material comprises a discharging screw conveyor which conveys the carbonized material being charged densely, an inside of the discharging screw conveyor being in an oxygen-free state by one or both of superheated steam and saturated steam flowing from the second rotary kiln into the discharging screw conveyor. Thereby, the carbonized material is discharged gradually from the second rotary kiln according to the treatment velocity, and the temperature of the treated material is lowered when the material passes through the discharging screw conveyor. Consequently, ignition and combustion of the treated material can be prevented. Further, since steam is used to keep the oxygen-free state, when the temperature of the material becomes below 100° C., where the material does not burn, the steam turns into water. Therefore, gas that needs treatment will not be generated and the apparatus configuration is simplified. Accordingly, in the apparatus for thermal treatment using superheated steam according to the present invention, it is preferable that a downstream side of the discharging screw conveyor comprising a humidifying zone, the material charged from an inlet side of the discharging screw conveyor being humidified by the superheated or saturated steam liquefied in the humidifying zone, the material is discharged with a temperature lower than 100° C. from an outlet of the discharging screw conveyor. Thereby, the material treated by the second rotary kiln can be discharged in a state of not burning after being properly humidified.

Still furthermore, in the apparatus for thermal treatment using superheated steam according to the present invention, it is preferable that the material to be treated is carbon-containing chemical compound, and the carbonized material (carbonized substance) of the carbon-containing chemical compound is discharged via the mechanism for discharging treated material. Thereby, the carbonized material can be used as such as activated carbon.

Still furthermore, in the apparatus for thermal treatment using superheated steam according to the present invention, it is preferable that furnace pressures of the first and second rotary kilns are respectively in a positive pressure state higher than atmospheric pressure during operation. Thereby, air is prevented from coming into the first and second rotary kilns and combustion of the material with the air can be prevented. Furthermore, the positive pressure state is preferably in a range where 10–100 mmAq or so is added to the atmospheric pressure. When the pressure is too high, a loss of heat energy is large, and when too low, air comes into the first and second rotary kilns partially.

Moreover, in the apparatus for thermal treatment using superheated steam according to the present invention, it is preferable that high temperature carbonization gas exhausted from one or both of the first and second rotary kilns is used as a part of a heat source to generate one or both of the first high temperature gas and the second high temperature gas. Thereby, with a little fuel or no fuel, the apparatus for thermal treatment using the superheated steam can be operated. Further, in the apparatus for thermal treatment using superheated steam according to the present invention, it is preferable that the carbonization gas being heated to a temperature of 800° C. or higher in a combustion furnace for odor contained therein to be removed, one or both of the first high temperature gas and the second high temperature gas are generated by utilizing retained heat of combustion exhaust gas from the combustion furnace.

DETAILED DESCRIPTION OF THE INVENTION

Next, a preferred embodiment of the present invention will be described hereunder with reference to the accompanying drawings for the present invention to be understood.

Figure 1:
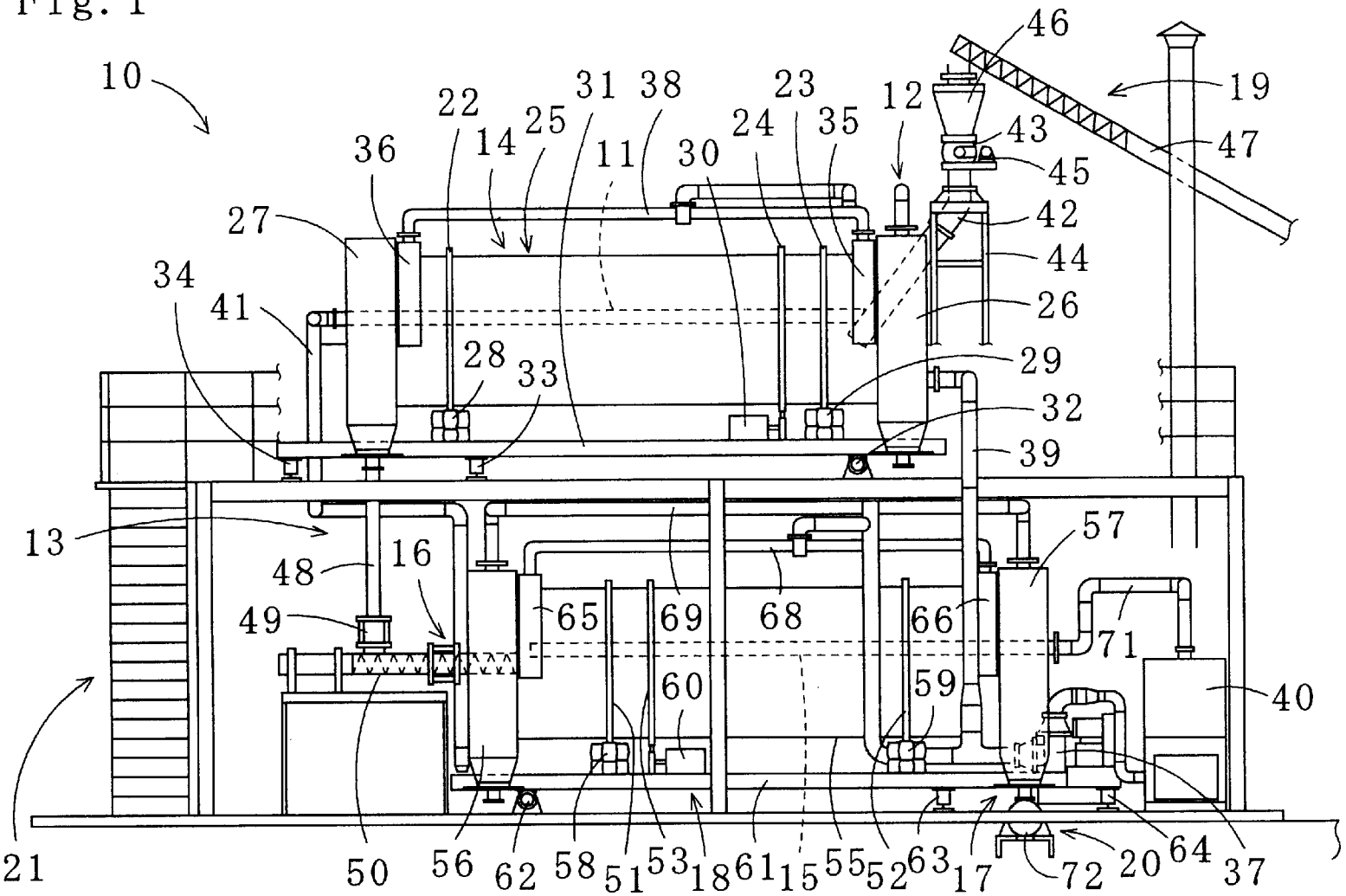
FIG. 1 is a partially-omitted side view of an apparatus for thermal treatment using superheated steam according to a preferred embodiment of the present invention.
Figure 2:
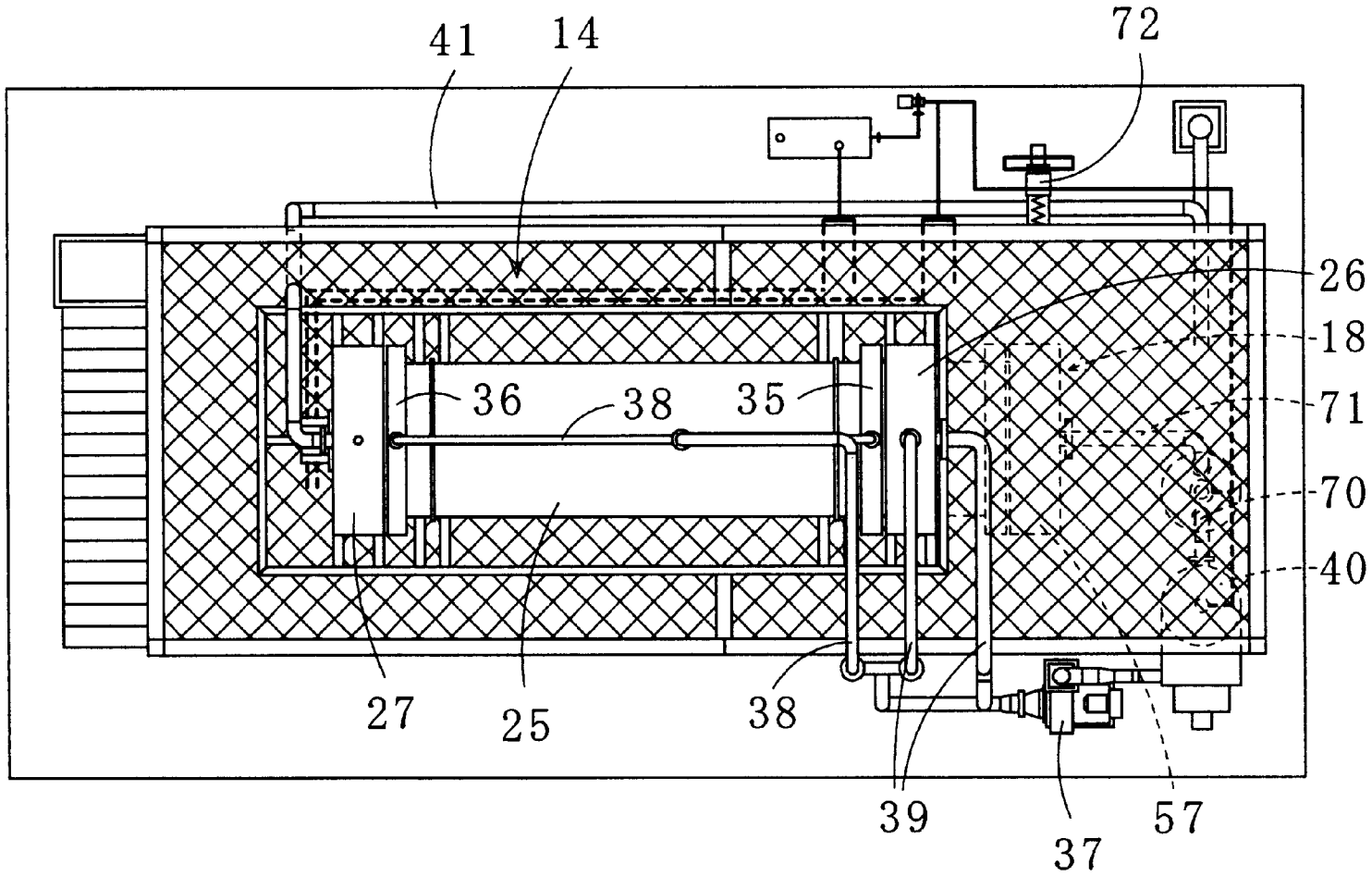
FIG. 2 is a plan view of the apparatus.

As shown in FIG. 1 and FIG. 2, an apparatus 10 for thermal treatment using superheated steam according to an embodiment of the present invention comprises: a first rotary kiln 14 having a first nozzle pipe 11 therein for spouting high temperature superheated steam which is an example of a first high temperature gas, a first charge portion 12 of material to be treated on one side thereof, and a first discharge portion 13 of the material with a high temperature on the other side thereof; a second rotary kiln 18 having a second nozzle pipe 15 therein for spouting very high temperature superheated steam which is an example of a second high temperature gas, a second charge portion 16 of the material dehydrated by the first rotary kiln 14 on one side thereof, and a second discharge portion 17 of the material thermally treated on the other side thereof; a material feeding device 19 for feeding the material to be treated to the first rotary kiln 14; a mechanism 20 for discharging treated material connected to the second discharge portion 17 of the second rotary kiln 18 for discharging the material outside; and a two-story frame 21 on which the first rotary kiln 14, the second rotary kiln 18, the material feeding device 19 and the mechanism 20 for discharging treated material are mounted. Hereafter, these will be described in detail. It is to be understood that the high temperature superheated steam is used for dehydration carried out in the first rotary kiln 14 in the embodiment, however, high temperature combustion exhaust gas can also be used.

The first rotary kiln 14 comprises a cylindrical kiln body 25 having two tires 22 and 23 on both sides outside thereof and a sprocket 24 for rotation, and an inlet-side hood 26 and an outlet-side hood 27 on both sides of the kiln body 25. A pair of right and left wheels 28 and 29 bearing the two tires 22 and 23 of the kiln body 25 respectively, and a reduction motor 30 provided at an output shaft thereof with a sprocket engagingly connected to the sprocket 24 via a chain are provided on an inclined frame 31. The inclined frame 31 is disposed to be inclinable against the frame 21 via a bearing 32 provided on one side of the frame 21 in a state that the kiln body 25 can be slanted downward to the outlet side within a range of e.g., 0.2 to 2 degrees from the horizon. Reference numerals 33 and 34 show bolsters on the other side of the inclined frame 31, and substantial inclination angle of the inclined frame 31 is changed by adjusting the heights of these bolsters 33 and 34.

Although the inlet-side hood 26 and outlet-side hood 27 are attached on the inlet and outlet sides of the kiln body 25 respectively by sealing device such as packing, steam leaks from a sliding portion since the kiln body 25 rotates while the inlet-side hood 26 and outlet-side hood 27 are provided to the inclined frame 31 in a fixed state through supporting members not shown. Therefore, by providing air intake hoods 35 and 36 on the inlet and outlet side portions of the kiln body 25 and a suction pipe 38 connected to a blower 37, the leaked steam is prevented from going outside. Furthermore, a suction pipe 39 connected to the blower 37 is provided also to the upper and middle portions of the inlet-side hood 26, and thereby steam inside of the kiln body 25 is exhausted outside by the blower 37.

Meanwhile, from the outlet side to the inlet side in the kiln body 25, the first nozzle pipe 11 is placed parallel to an axis of the kiln body 25 in a fixed sate. The nozzle pipe 11 comprises nozzles for spouting high temperature gas on its periphery at predetermined intervals in the kiln body 25 and supplies high temperature superheated steam (200 to 700° C.) generated by a boiler 40 which heats water to be steam and further heats the steam to be high temperature steam into the rotary kiln 14 via a first pipe 41 for supplying superheated steam.

The kiln body 25 is provided at the inlet thereof with the first charge portion 12 for supplying the material to be treated. The first charge portion 12 comprises a chute pipe 42 inserted into the kiln body 25 on a slant, and a rotary valve (rotary feeder) 43 to which the proximal end of the chute pipe 42 is connected. The rotary valve 43 is mounted on an auxiliary frame 44 that is higher than the kiln body 25. The rotary valve 43 has a structure that the material stored in a sub-hopper 46 provided above is charged into the first rotary kiln 14 little by little, more concretely, the material is put into an edge portion of the inlet side of the kiln body 25 by rotation of a inner partition blade arranged radiantly and driven by a motor 45.

The sub-hopper 46 is provided with an inclined conveyor 47 comprising a screw conveyor. When the material in the sub-hopper 46 runs short, the material in a material reservoir hopper not shown is conveyed little by little into the sub-hopper 46 by the inclined conveyor 47 in an airtight state. Further, the above-described material feeding device 19 is configured to comprise the material reservoir hopper, the inclined conveyor 47 and the sub-hopper 46.

The outlet-side hood 27 is provided with the first discharge portion 13. The discharge portion 13 has a discharging chute 48 comprising a pipe provided on a bottom part of the outlet-side hood 27, and a switching valve 49 provided below the discharging chute 48. The outlet side of the switching valve 49 is connected to the second charge portion 16 of the second rotary kiln 18. The second charge portion 16 has a carry-in conveyor 50 comprising a screw conveyor for feeding material, and by means of the carry-in conveyor 50, the material dehydrated by the first rotary kiln 14 is fed to the second rotary kiln 18.

The second rotary kiln 18 is fundamentally the same as the first rotary kiln 14, however, it will be described again hereunder. The second rotary kiln 18 comprises a cylindrical kiln body 55 having two tires 51 and 52 on both sides outside thereof and a sprocket 53 for rotation, and an inlet-side hood 56 and an outlet-side hood 57 on both sides of the kiln body 55. A pair of right and left wheels 58 and 59 bearing the two tires 51 and 52 respectively, and a reduction motor 60 provided at an output shaft thereof with a sprocket engagingly connected to the sprocket 53 via a chain are provided on an inclined frame 61. The inclined frame 61 is disposed to be inclinable at a first floor of the frame 21 via a bearing 62 provided on one side of the frame 21 in a manner that the kiln body 55 can be slanted downward to the outlet side within an range of e.g., 0.1 to 3 degrees, still preferably 0.2 to 2 degrees, from the horizon. Reference numerals 63 and 64 show bolsters on the other side of the inclined frame 61.

Although the inlet-side hood 56 and outlet-side hood 57 are attached on the inlet and outlet sides of the kiln body 55 respectively by sealing device such as packing, steam leaks from a sliding portion since the kiln body 55 rotates while the hoods 56 and 57 are provided to the inclined frame 61 in a fixed state through supporting members not shown. Therefore, by providing air intake hoods 65 and 66 on the inlet and outlet sides of the kiln body 55, and a suction pipe 68 connected to the blower 37, the leaked steam is prevented from going outside. Moreover, the inlet-side hood 56, like the inlet-side hood 26 of the first rotary kiln 14, is provided with a drain outlet to drain water on the bottom thereof. In addition, a suction pipe 69 connected to the blower 37 is provided to the upper portions of the hoods 56 and 57. Thereby steam inside of the kiln body 55 is exhausted outside by the blower 37.

Figure 3:
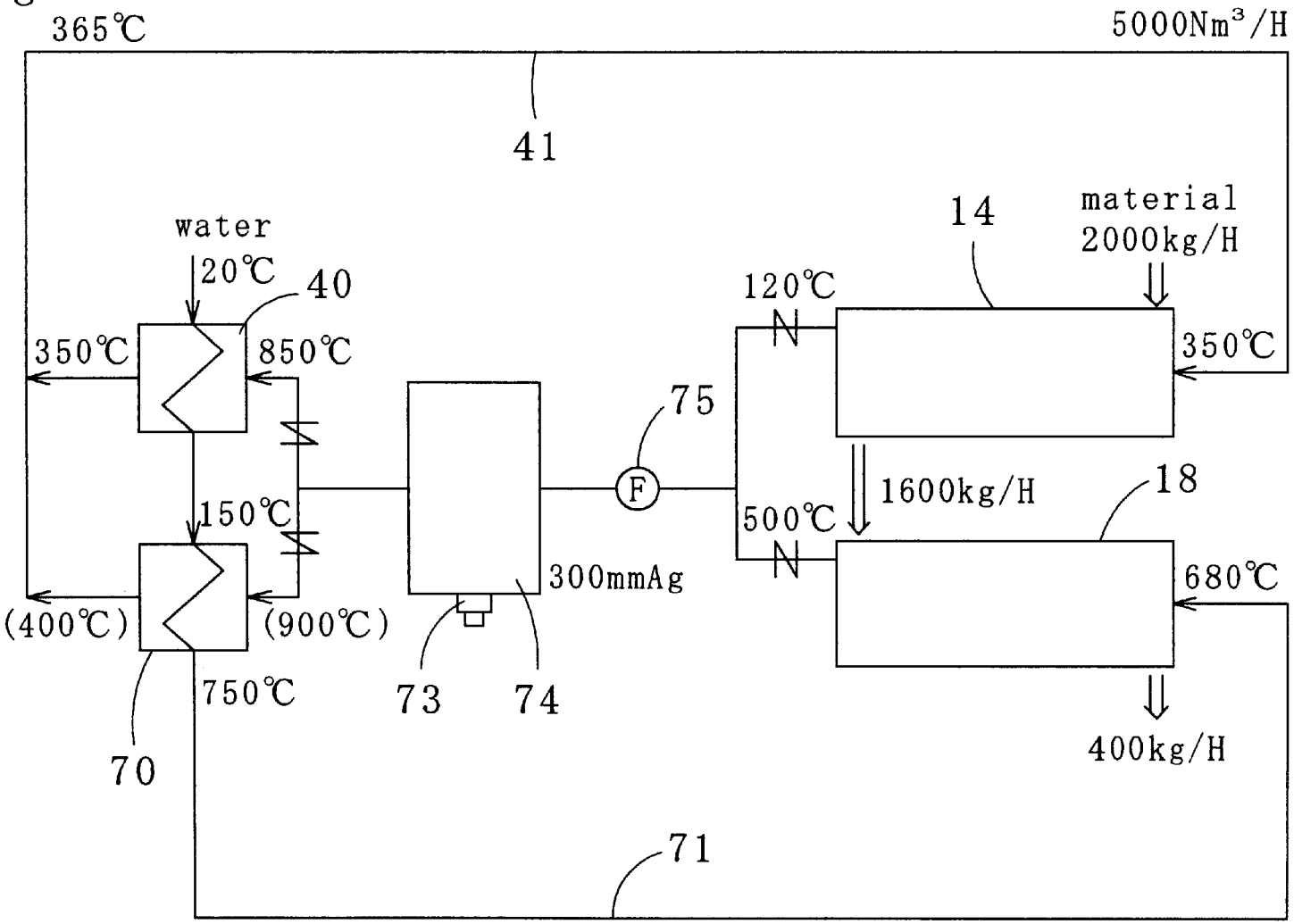
FIG. 3 is a block diagram showing the flow of the superheated steam and material to be treated in the apparatus.

From the outlet side to the inlet side in the kiln body 55, the second nozzle pipe 15 is placed parallel to an axis of the kiln body 55 in a fixed state. The nozzle pipe 15 comprises nozzles for spouting high temperature gas on its periphery at predetermined intervals in the kiln body 55, and as shown in FIG. 3, supplies very high temperature superheated steam (400–1000° C.) which is obtained by further heating high temperature steam (200–700° C.) generated from the boiler 40 by a steam heater (superheater) 70 into the second rotary kiln 18 via a second pipe 71 for supplying superheated steam. Further, high temperature and very (super) high temperature superheated steam (200–1000° C.) can be obtained by heating saturated steam generated from the boiler 40 by means of a steam heater (fire steamer or superheater) at a time.

The material discharged from the kiln body 55 falls into the outlet-side hood 57, and the second discharge portion 17 is provided at the bottom portion of the outlet-side hood 57. At the lower part of the second discharge portion 17, the mechanism 20 for discharging treated material is provided, which discharges the heated material outside after lowering the temperature thereof in a oxygen-free state so that the treated material may not burn by itself in an atmosphere, that is, discharges the carbonized material with a temperature at which spontaneous combustion does not occur. In this embodiment, by means of a discharging screw conveyor 72 which is about 3 m (preferably, 2–5 m) in the total length and provided to the mechanism 20 for discharging treated material, the material thermally treated and reduced in its volume by the second rotary kiln 18 is conveyed gradually in a state where oxygen is removed by a superheated steam and the temperature of the material to be discharged is lowered to 100° C. or lower. For rotation of the screw of the screw conveyor 72, a variable speed motor is used which discharges the heated material while adjusting a conveying speed according to the amount of the material and filling the conveyor route of the screw conveyor 72 with the material. Accordingly, the material discharged from the kiln body 55 falls from the second discharge portion 17 of the outlet-side hood 57 into the screw conveyor 72 and then is discharged outside while being cooled slowly.

Further, since the kiln bodies 25 and 55 of the first and second rotary kilns 14 and 18 are used at high temperatures, the kiln bodies 25 and 55 are made of heat-resistant materials, such as stainless steel and heat-resistant steel, and to the inside of the each kiln body, bricks with strength (tough bricks), heat- and abrasion-resistant ceramics such as alumina or the like are attached. Additionally, outer surfaces of the kiln bodies 25 and 55 can be coated with fire-resistant materials, and furthermore, the kiln bodies 25 and 55 can be covered with heat-insulating materials.

Next, working (operation) of the apparatus 10 for thermal treatment using superheated steam and a heating system of the first and second rotary kilns 14 and 18 of the apparatus 10 will be described concretely. It is to be understood that though the kiln bodies 25 and 55 with inside diameters of 1.6 m and lengths of 5 m are used in this embodiment, the present invention is not limited to these numbers.

A mechanism of generating superheated steam to be supplied to the first and second rotary kilns 14 and 18 will be described. As shown in FIG. 3, a combustion furnace 74 has a supplemental burner 73 using heavy oil, LPG and exhaust gas from the first and second rotary kilns 14 and 18 as a fuel, and combustion exhaust gas from the combustion furnace 74 is supplied to the boiler 40 and the steam heater 70. In the boiler 40, supplied water of about 20° C. is first heated to be steam and further heated to be high temperature superheated steam of 100–700° C. (150° C. in this embodiment), and in the steam heater 70, the high temperature superheated steam is further heated to be very high temperature superheated steam of 400–1000° C. (750° C. in this embodiment).

Accordingly, while high temperature superheated steam of about 350° C. (as mentioned above, high temperature combustion exhaust gas can also be used) is ejected from the first nozzle pipe 11 into the first rotary kiln 14, carbon-containing chemical compound such as a wood chip fractured to 0.5–2 cm which is an example of organic waste is charged into the first rotary kiln 14 at a speed of e.g. 2000 kg/hour via the material feeding device 19 and the first charge portion 12.

In the first rotary kiln 14, the material to be treated is heated at high temperature and even when much water is contained, the material is dehydrated and may be carbonized partially. Here, the superheated steam discharged from the suction pipes 38 and 39 has a temperature of about 120° C. However, since the steam is a gaseous body, it is easily recovered by suction. This superheated steam includes flammable gas (carbonization gas) generated during thermal decomposition of the material. Further, since a residence or retention time of the material in the first rotary kiln 14 varies with the rotation speed of the kiln body 25 (normally, 0.3–5 rpm) and the inclination of the kiln body 25, the residence time is adjusted so that the material can be dehydrated thoroughly.

The material finished with dehydration in the first rotary kiln 14 is charged into the second rotary kiln 18 via the first discharge portion 13 by means of the carry-in conveyor 50 mainly comprising the second charge portion 16. Since water has been removed from the material by this point, charging amount is about 1600 kg/hour or so.

To the second rotary kiln 18, very high temperature superheated steam with a temperature of about 680° C. heated by the steam heater 70 is supplied via the second nozzle pipe 15. When the material to be treated is exposed to such very high temperature superheated steam in an oxygen-free state, flammable gas generates as organic material is carbonized and contained elements except carbon in the material are decomposed. Here, when the material to be treated is, for example, a rain water gutter made of hard vinyl chloride, carbon monoxide and hydrogen generate and further, the generated hydrogen reacts on chlorine generated during carbonization of the rain water gutter and forms hydrogen chloride, which results in preventing dioxin from generating. In this case, a neutralization tank for hydrogen chloride (e.g., tank containing particles of alkaline chemicals such as NaOH) is provided in an exhaust gas way to recover contained hydrogen chloride.

The material to be treated which is carbonized in such a way (carbonized material) is supplied to the inlet side of the screw conveyor 72 of the mechanism 20 for discharging treated material via the second discharge portion 17. As same in the first rotary kiln 14, since the superheated steam in the second rotary kiln 18 is pressurized to about 30 mmAq, part of the superheated steam goes into the screw conveyor 72 from the outlet-side hood 57. Thereby, as the outlet-side hood 57 becomes free of oxygen, the inside of the screw conveyor 72 also becomes free of oxygen. Since the total length of the screw conveyor 72 is long, the carbonized material is cooled while passing through the screw conveyor 72, and the temperature of the carbonized material becomes lower than 100° C. at the outlet side of the screw conveyor 72. As the temperature of the superheated steam is also lowered, the superheated steam is liquefied, and consequently, the carbonized material is humidified at the downstream side (humidifying zone) of the screw conveyor 72. Since a degree of humidification varies with the conveying speed of the screw conveyor 72, the temperature and pressure of the superheated steam or saturated steam, by controlling these appropriately, the carbonized material with a predetermined humidity (e.g., 5–10%) can be obtained.

The material charged at 1600 kg/hour is discharged at about 400 kg/hour from the second rotary kiln 18. When the material is exposed to the very high temperature superheated steam, the material is carbonized by applied heat and flammable carbonization gas is generated. The temperature of the exhaust gas from the second rotary kiln 18 in this case was about 500° C.

The exhaust gas is pressurized to about 300 mmAq or so by a fan 75 and charged into the combustion furnace 74. Since the supplemental burner 73 is provided to the combustion furnace 74, all combustibles in the exhaust gas burn. Thereby, the inside temperature of the combustion furnace 74 is made to be about 800–1000° C. (preferably, 850–900° C.) and odor or the like contained in the exhaust gas is removed substantially perfectly. Further, primary combustion air or oxygen is supplied to the combustion furnace 74 when necessary. Combustion exhaust gas with a temperature of 850–900° C. or so which comes out of the combustion furnace 74 as described above is heat exchanged by the boiler 40 and the steam heater 70 and generates high temperature or very high temperature superheated steam by utilizing its retained heat. Exhaust gas, which passed through the boiler 40 and the steam heater 70, is released into the air as it is. Here, it is to be noted that the exhaust gas still comprises the retained heat and thus, as a matter of course, can be used as an energy source such as to preheat water. In this embodiment, since the material to be treated is the wood chips, a great amount of flammable gas is mixed with the exhaust gas. Therefore, the exhaust gas can be a fuel in the combustion furnace 74 and a fuel to the supplemental burner 73 can be extremely saved.

Furthermore, in the first rotary kiln 14, a supplemental burner not shown is provided to the outlet-side hood 27. When the apparatus 10 for thermal treatment using superheated steam is started under condition that the temperature of the kiln body 25 has not been raised, even if the high temperature superheated steam is blown in, the steam temperature immediately drops and dehydration of the material becomes difficult. Therefore, after the kiln body 25 is preheated by the supplemental burner, the apparatus 10 for thermal treatment using superheated steam is operated. Although this is the same for the second rotary kiln 18, since it takes time for the material to reach the second rotary kiln 18, during that time, the kiln body 55 can be heated by very high temperature superheated steam supplied.

Also, in the second rotary kiln 18, since superheated steam with a temperature exceeding about 370° C. (also called inversion temperature) is used, the larger the amount of water in the superheated steam is, the faster the speed of dehydration and the speed of rising temperature become, and thus heat transfer becomes efficient. In this case, if the superheated steam from the nozzles for spouting high temperature gas provided to the second nozzle pipe 15 is in direct contact with the material to be treated, efficiency of dehydration improves. Thereby, the thermal treatment (e.g., carbonization) can be carried out in a relatively short time.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims. For example, in the above-described embodiment, the wood chip is applied as the material to be treated, however, such as garbage, chicken dropping, livestock excrement, municipal sludge, sludge of human waste, scrap wood generated in construction, food wastes, carbon-containing waste plastics and so on can be other materials to be treated, and the present invention is not limited to these.

Further, although the material is dehydrated in the first rotary kiln 14 and then carbonized in the second rotary kiln 18, both of the first and second rotary kilns 14 and 18 can be used for dehydration depending on the material to be treated.

Moreover, although the kiln bodies 25 and 55 of the first and second rotary kilns 14 and 18 are chain driven in the above-described embodiment, wheels on which the kiln bodies 25 and 55 are mounted can be driven.

Further, although the first and second nozzle pipes 11 and 15 which are laid inside of the first and second rotary kilns 14 and 18 are parallel to the axes of the kiln bodies 25 and 55 respectively, the nozzle pipes are not necessary to be parallel or straight and can be laid e.g., in a zigzag manner.

In the above-described embodiment, though the exhaust gases from both of the first and second rotary kilns 14 and 18 are introduced into the combustion furnace 74, the present invention can be applied to a case where the exhaust gas from one of the kilns 14 and 18 is introduced into the combustion furnace depending on the treatment temperatures of the first and second rotary kilns and the material to be treated. Further, in the apparatus for thermal treatment of the present invention, it is preferable to use the first and second rotary kilns for continuous treatment. However, the present invention can be applied to a case where the first and second rotary kilns are used for batch treatment.

What is claimed is:

1. An apparatus for thermal treatment using superheated steam comprising:

a first rotary kiln having a first nozzle pipe therein for spouting a first high temperature gas, a first charge portion of material to be treated on one side thereof and a first discharge portion of the material dehydrated with the first high temperature gas on other side thereof, the first high temperature gas comprising one or both of high temperature superheated steam and high temperature combustion exhaust gas;

a second rotary kiln having a second nozzle pipe therein for spouting a second high temperature gas, a second charge portion of the material dehydrated by the first rotary kiln on one side thereof and a second discharge portion of the material carbonized with the second high temperature gas on other side thereof respectively, the second high temperature gas comprising mainly high temperature superheated steam with a temperature higher than a temperature of the first high temperature gas; and a mechanism for discharging treated material provided to the second discharge portion of the second rotary kiln for discharging the carbonized material outside after lowering a temperature of the material in an oxygen-free state so that spontaneous combustion of the carbonized material may not occur in an atmosphere, wherein the first rotary kiln is disposed above the second rotary kiln, the first discharge portion of the first rotary kiln has a chute for discharging the material form the first rotary kiln, a screw conveyor for feeding material which feeds the material discharged form the chute into the second rotary kiln is provided to the second charge portion of the secondary rotary kiln, and the first discharge portion and the second discharge portion are connected.

2. The apparatus for thermal treatment using superheated steam according to claim 1, wherein the first and second nozzle pipes are extended in a fixed state from one side to other side in kiln bodies of the first and second rotary kilns respectively, many nozzles for spouting high temperature gas being provided at intervals to the first and second nozzle pipes respectively.

3. The apparatus for thermal treatment using superheated steam according to claim 2, wherein the first and second nozzle pipes are in parallel with axes of the respective kiln bodies of the first and second rotary kilns.

4. The apparatus for thermal treatment using superheated steam according to claim 1, wherein the first and second nozzle pipes are extended in a fixed state from one side to other side in kiln bodies of the first and second rotary kilns respectively, many nozzles for spouting high temperature gas being provided at intervals to the first and second nozzle pipes respectively.

5. The apparatus for thermal treatment using superheated steam according to claim 4, wherein the first and second nozzle pipes are in parallel with axes of the respective kiln bodies of the first and second rotary kilns.

6. The apparatus for thermal treatment using superheated steam according to claim 1, wherein the first high temperature gas supplied to the first rotary kiln is comprised of high temperature gas in a range of 200 to 700° C., and the second high temperature gas supplied to the second rotary kiln is comprised of superheated steam in a range of 400 to 1000° C.

7. The apparatus for thermal treatment using superheated steam according to claim 1, wherein the mechanism for discharging treated material comprises a discharging screw conveyor which conveys the carbonized material being charged densely, an inside of the discharging screw conveyor being in an oxygen-free state by one or both of superheated steam and saturated steam flowing from the second rotary kiln into the discharging screw conveyor.

8. The apparatus for thermal treatment using superheated steam according to claim 7, wherein a downstream side of the discharging screw conveyor comprising a humidifying zone, the material charged from an inlet side of the discharging screw conveyor being humidified by the steam liquefied in the humidifying zone, the material is discharged with a temperature lower than 100° C. from an outlet of the discharging screw conveyor.

9. The apparatus for thermal treatment using superheated steam according to claim 1, wherein the mechanism for discharging treated material comprises a discharging screw conveyor which conveys the carbonized material being charged densely, an inside of the discharging screw conveyor being in an oxygen-free state by one or both of superheated steam and saturated steam flowing from the second rotary kiln into the discharging screw conveyor.

10. The apparatus for thermal treatment using superheated steam according to claim 9, wherein a downstream side of the discharging screw conveyor comprising a humidifying zone, the material charged from an inlet side of the discharging screw conveyor being humidified by the steam liquefied in the humidifying zone, the material is discharged with a temperature lower than 100° C. from an outlet of the discharging screw conveyor.

11. The apparatus for thermal treatment using superheated steam according to claim 1, wherein the material to be treated being carbon-containing chemical compound, carbonized material of the carbon-containing chemical compound is discharged via the mechanism for discharging treated material.

12. The apparatus for thermal treatment using superheated steam according to claim 1, wherein furnace pressures of the first and second rotary kilns are respectively in a positive pressure state that is higher than atmospheric pressure during operation.

13. The apparatus for thermal treatment using superheated steam according to claim 1, wherein high temperature carbonization gas exhausted from one or both of the first and second rotary kilns is used as a part of a heat source to generate one or both of the first high temperature gas and the second high temperature gas.

14. The apparatus for thermal treatment using superheated steam according to claim 13, herein the carbonization gas being heated to a temperature of 800° C. or higher in a combustion furnace for odor contained therein to be removed, one or both of the first high temperature gas and the second high temperature gas are generated by utilizing retained heat of conbustion exhaust gas from the combustion furnace.

* * * * *